US008915049B2

(12) United States Patent
Haering

(10) Patent No.: US 8,915,049 B2
(45) Date of Patent: Dec. 23, 2014

(54) PACKAGING MACHINE AND METHOD FOR PACKAGING OF PRODUCTS IN BAGS

(75) Inventor: Rainer Haering, Lauben (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 1253 days.

(21) Appl. No.: 12/384,891

(22) Filed: Apr. 8, 2009

(65) Prior Publication Data

US 2009/0260325 A1 Oct. 22, 2009

(30) Foreign Application Priority Data

Apr. 18, 2008 (DE) ..... 10 2008 019 629

(51) Int. Cl.
*B65B 31/02* (2006.01)

(52) U.S. Cl.
CPC ..... *B65B 31/024* (2013.01)
USPC ..... 53/434; 53/512; 53/403; 53/86

(58) Field of Classification Search
CPC ..... B65B 31/024
USPC ..... 53/403, 405, 408, 427, 434, 509, 512, 53/79, 86, 87, 110
IPC ..... B65B 31/02
See application file for complete search history.

(56) References Cited

U.S. PATENT DOCUMENTS 2,423,975 A 7/1947 Helm
2,672,268 A 3/1954 Bower
3,994,101 A * 11/1976 Coburn et al. ..... 451/388
4,132,048 A 1/1979 Day
4,545,177 A * 10/1985 Day ..... 53/434
4,920,726 A * 5/1990 Yamada et al. ..... 53/79
5,002,464 A * 3/1991 Lee ..... 417/152
5,012,535 A * 5/1991 Klotzbach ..... 4/541.2
5,056,292 A 10/1991 Natterer
5,964,255 A 10/1999 Schmidt
6,012,265 A * 1/2000 Ady ..... 53/510
6,030,486 A * 2/2000 Loewenhardt et al. .. 156/345.46

(Continued)

FOREIGN PATENT DOCUMENTS

DE 429832 C 6/1926
DE 2323458 A * 11/1974

(Continued)

OTHER PUBLICATIONS

Machine translation of JP 10-236427 A, retrieved Jul. 13, 2011 from JPO website http://www4.ipdl.inpit.go.jp/Tokujitu/tjsogodbenk.ipdl, 30 pages.*

(Continued)

*Primary Examiner* — Stephen F Gerrity
(74) *Attorney, Agent, or Firm* — Brooks Kushman P.C.

(57) ABSTRACT

A packaging machine and a method for packaging of products in bags, respectively, comprises a lid (5) forming a chamber (4) together with a chamber bottom (6). The object of the invention is to provide an improved device and method for evacuating the chamber (4) of a packaging machine. For this purpose a suction device (100) is provided in the chamber bottom (6), the suction device being designed such that gas can be sucked and the chamber (4) can be closed gas tight, wherein at least a closing element (8, 8') is provided which can be moved from a first raised position into a second lowered position.

20 Claims, 4 Drawing Sheets

(56) References Cited

U.S. PATENT DOCUMENTS

| | | | | |
|---|---|---|---|---|
| 6,971,418 | B2 | 12/2005 | De Costa | |
| 2003/0046907 | A1 | 3/2003 | Costello | |
| 2004/0060262 | A1 * | 4/2004 | Harges et al. | 53/434 |
| 2004/0195535 | A1 | 10/2004 | Garnreiter et al. | |
| 2006/0096838 | A1 * | 5/2006 | Buchko | 53/434 |

FOREIGN PATENT DOCUMENTS

| | | | | |
|---|---|---|---|---|
| DE | 27 13 896 | | 10/1985 | |
| DE | 39 16 170 | | 11/1990 | |
| DE | 4033491 | A1 | 4/1992 | |
| DE | 4114122 | A1 | 11/1992 | |
| EP | 1403185 | A1 | 3/2004 | |
| JP | 10236427 | A * | 9/1998 | B65B 31/02 |
| WO | 03/038322 | A1 | 5/2003 | |

OTHER PUBLICATIONS

European Search Report Dated Aug. 7, 2009, Application No. 09158041.5-2308, Applicant: MULTIVAC Sepp Haggenmueller GmbH & Co KG, 5 Pages.

* cited by examiner

PACKAGING MACHINE AND METHOD FOR PACKAGING OF PRODUCTS IN BAGS

CROSS-REFERENCE TO RELATED APPLICATION

This application claims foreign priority benefits under 35 U.S.C. §119(a)-(d) to German Patent application No. DE 10 2008 019 629.0, filed Apr. 18, 2008, which is incorporated by reference in its entirety.

The present invention refers to a packaging machine and a method for packaging of products in bags, in particular for a chamber belt machine.

In the field of a chamber belt machines normally a suction device is provided in the lid of the machine for evacuating a vacuum chamber. Since the vacuum pump is generally provided under the packaging machine or a central vacuum apparatus is provided near to the packaging machine the suction device has to be connected through long pipes or tubes with the suction device in the lid of the machine. This interferes with the time sequence of the vacuum production in the chamber and has as consequence a high susceptibility for errors in the system, increased amount of cost and little attractive optical appearance.

Therefore, it is the object of the present invention to provide an improved device and method for evacuating the vacuum chamber in a packaging machine.

By providing a suction device in the bottom of the chamber of the chamber belt machine long pipes and tubes leading to the vacuum pump are avoided. Furthermore, the device forms simultaneously a suction device and a sealing device of the vacuum chamber. Therefore, only one drive unit is necessary for both functions, whereby space and cost are saved.

Figure 1:
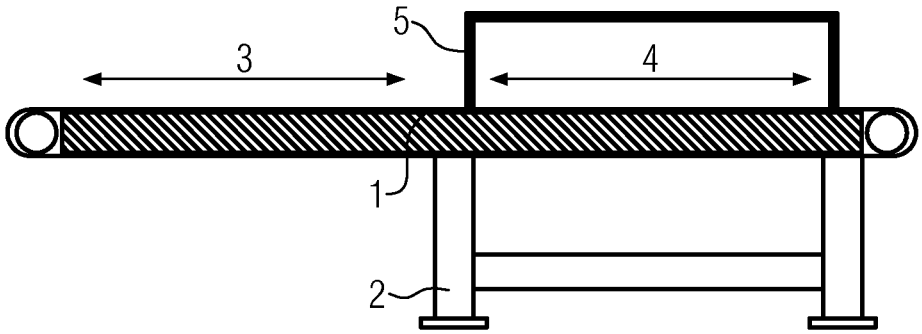
Figure 2A:
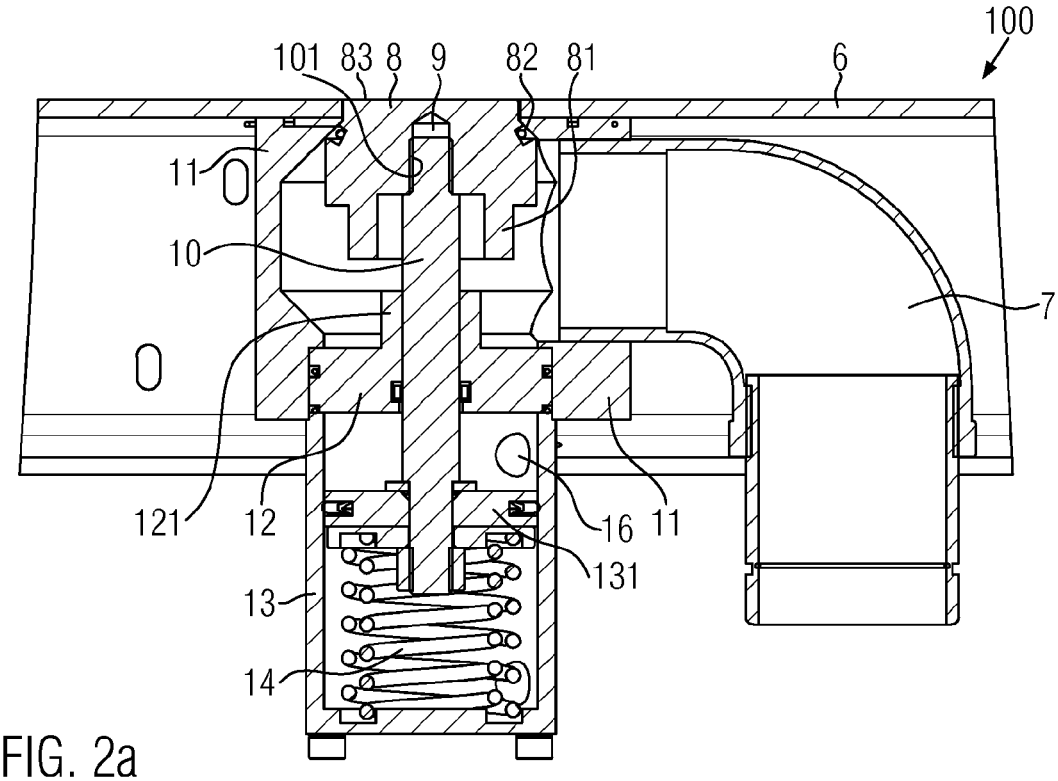
Figure 2B:
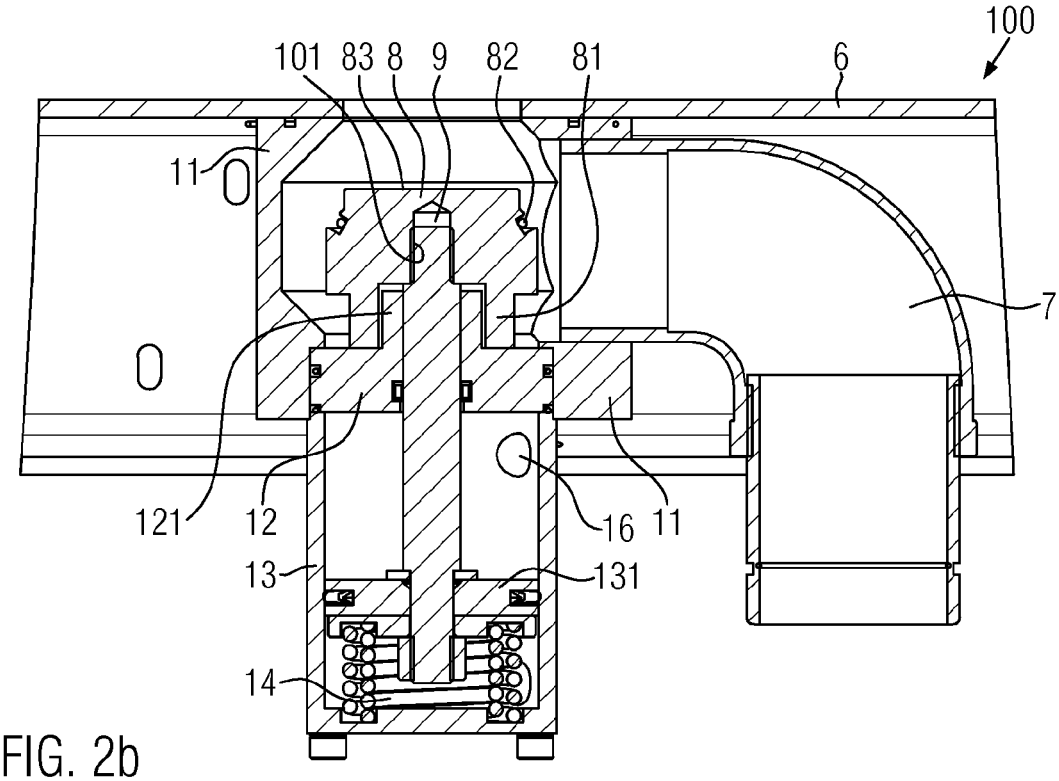
Figure 3A:
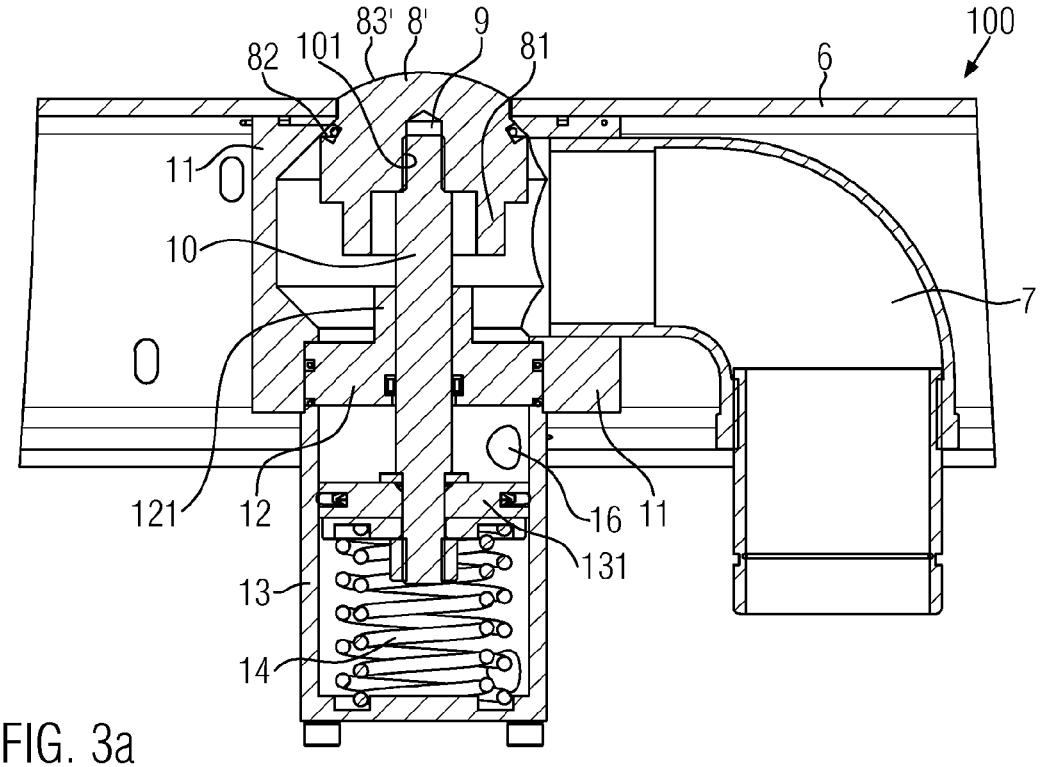
Figure 3B:
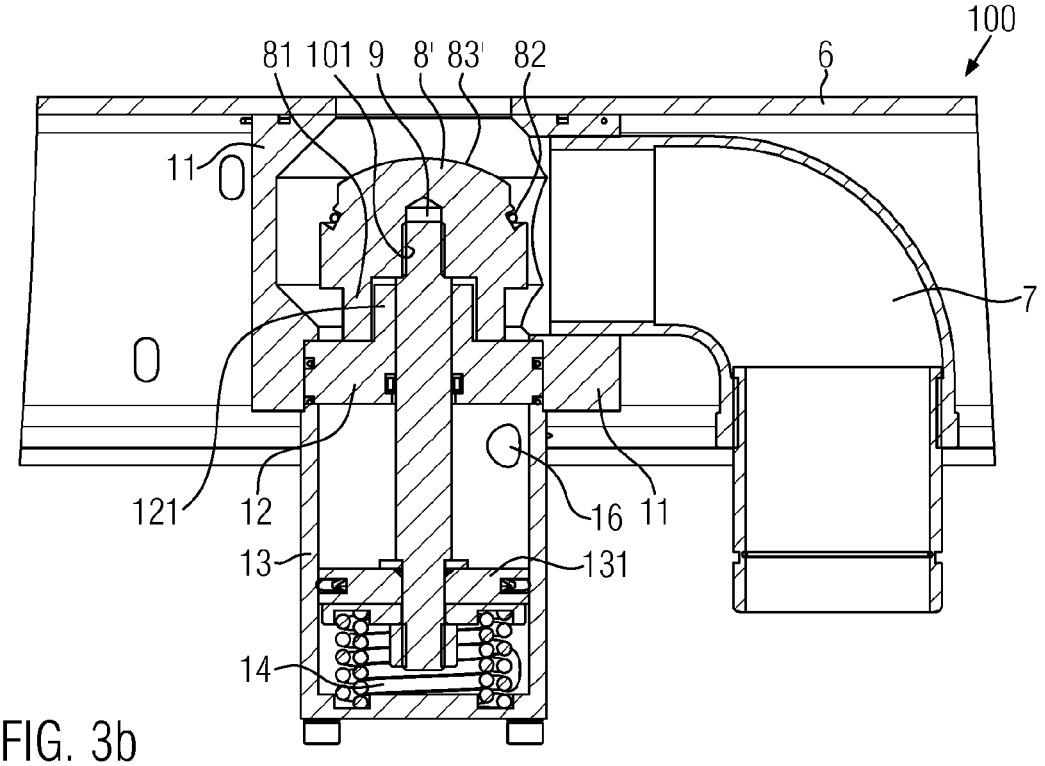
Figure 4:
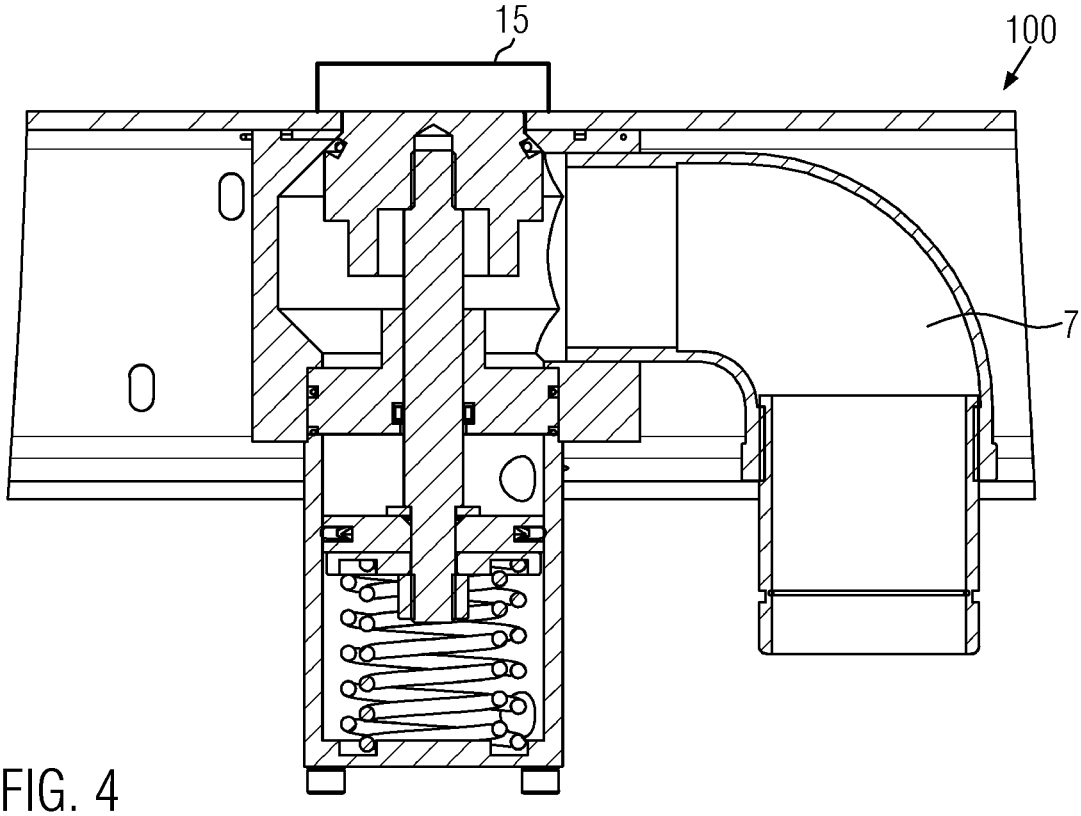

Further features and advantages of the invention follow from the description of embodiments using the enclosed drawings. In the figures:

FIG. 1 shows a schematical side view of a chamber belt machine;

FIG. 2*a* shows a schematical sectional view of a suction device with lifted planar closing element;

FIG. 2*b* shows a schematical sectional view of the suction device with lowered planar closing element;

FIG. 3*a* shows a schematical view of the suction device with lifted convex closing element;

FIG. 3*b* shows a schematical view of the suction device with lowered convex closing element;

FIG. 4 shows a schematical sectional view of the suction device with lifted planar closing element and placed on grid.

In the following referring to FIG. 1 to FIG. 2*b* a first embodiment of the invention is described exemplarily with a chamber belt machine. In the present embodiment the chamber belt machine is formed as an automatic chamber belt machine.

FIG. 1 shows a schematical view of a chamber belt machine comprising a conveyor belt 1, a rack 2, a placing region 3, a chamber 4 and a lid 5. The chamber 4 is formed by the lid 5 together with a chamber bottom 6 (see FIG. 2*a*), wherein the lid 5 opens exemplarily automatically driven by a motor or may be opened manually in order to exemplarily accommodate bags to be evacuated or to be sealed which are automatically delivered by the conveyor belt 1 and which closes thereafter to form the chamber 4.

FIG. 2*a* shows a schematical sectional view of a part of the chamber belt machine in the region of the suction device 100. The suction device 100 is essentially provided directly beneath the chamber bottom 6. A closing element 8 provided in the shape of a bolt forms a plane together with the chamber bottom 6 in this lifted position of the closing element 8 since a closing element surface 83 or a bolt surface, respectively, is essentially formed planar and is on the same level as the chamber bottom 6. This creates the condition for hygienic operation of the device. It is also possible that the closing element extends somewhat beyond the plane of the chamber bottom 6. The closing element 8 closes the opening in the chamber bottom 6 and is formed such that it can function as a valve. The closing element 8 comprises a centrally bore 9 in FIG. 2*a* applied from below having a thread 101 into which is screwed a piston rod 10. The piston rod 10 also is provided at its upper end with a corresponding thread for this purpose.

The closing element is moved by a first casing part 11 in a direction perpendicular to the chamber bottom 6, in this embodiment a vertical direction. The piston rod 10 is guided in the vertical direction by a second casing part 12, wherein the second casing part 12 is pushed into the lower region of the first casing part 11.

In the lower region of the closing element 8 distant from the chamber bottom a sleeve shaped centering outer portion 81 is integral therewith provided which in the operation engages with a centering inner portion 121 of the second casing part 12 in the lower position of the closing element 8. This serves for the exact linear guiding of the piston rod 10.

The piston rod 10 is vertically slidable. At its lower end the piston rod 10 is fixedly connected to a piston 131 which is inserted into a third casing part 13 vertically slidable. The third casing part 13 comprises a cylindrical shape to accommodate the piston 131 and to guide it. In the third casing part 13 a spring element is provided which at one side is connected with the bottom of the third casing part 13 and on the other side is connected with the lower face the piston 131. In the third casing part 13 above the piston 131 a pressurized air supply 16 is also provided by which the piston 131 is moved during the operation.

In order to secure a tight closure of the chamber 4 (see FIG. 1) a sealing 82 exemplarily as an O-ring is provided between the closing element 8 and the first casing part 11. Further a suction pipe 7 is provided in the form of a 90° pipe elbow.

FIG. 2*b* shows the suction device 100 in the operation position. The third casing part 13, the piston rod 10 and the piston 131 are designed in this embodiment as a unidirectional acting pneumatic cylinder. By introducing of pressurized air into the third casing part 13, the piston 131 is moved downwards. Returning of the cylinder and the piston rod 10, respectively, takes place by the return force of the spring element 14 tensioned in the lower position of the closing element 8. The piston 131 may also be moved by sucking the air in the lower region of the third casing part 13. In this case the same vacuum pump could be used which evacuates the chamber 4 (see FIG. 1).

The spring element 14 is tensioned or compressed by the piston 131, respectively, in this position. In this position the vacuum pump can evacuate the chamber 4 through the suction pipe 7 and the gap created by the lowered closing element 8 (see FIG. 1). The returning force of the spring element 14 moves the piston 131 and therefore the piston rod 10 and the closing element 8, respectively, thereafter again to the lifted original position in which the closing element 8 closes with the chamber bottom 6 gas tight through the first casing part 11.

FIG. 3*a* shows in a second embodiment of the present invention the same construction as in FIG. 2*a* with the exception that the closing element surface 83' of the closing element 8' is not planar but convex and extends in its lifted position at least partially beyond the chamber bottom 6. In this manner during operation it should be prevented that liquids or contaminations in solid form accumulate on the closing element 8' which are sucked into the suction device 100 during lowing of the closing element 8' and contaminate the same.

FIG. 3*b* accordingly shows the same construction as in FIG. 2*b*, also with the same exception that the closing element 8' is formed convex. This has no influence on the function of the suction device 100 during evacuating the chamber 4 (see FIG. 1).

FIG. 4 shows the same construction of the suction device 100 as in FIG. 2*a*. Further, a grid 15 is provided. The grid is mounted on a suction opening, which opens as soon as the closing element 8, 8' is lowered (see FIGS. 2*a*-3*b*). The grid should prevent that during the evacuation of the chamber 4 (see FIG. 1) bag rests or product rests can enter into the suction pipe 7 or into the moving mechanism of the suction device 100. The grid 15 can be provided arbitrarily. For example it is conceivable to mount a cylindrical ring onto the chamber bottom 6 and to fix thereon a circular shaped grid 15, which is useful in an embodiment with the convex closing element surface 83.

The danger of sucking a bag or a bag neck by the suction device 100 or applying the grid 15, respectively, and a resulting disturbance of function during the operation does not exist since the suction device 100 is preferably provided in a corner of the chamber 4 (see FIG. 1).

It is also conceivable to provide a plurality of valves and/or vacuum pumps for improving the performance.

The invention is not limited to the application of a chamber belt machine. It is also applicable to a chamber machine without conveyor belt.

The invention claimed is:

1. A packaging machine for packaging of products in bags, the packaging machine comprising;

a chamber having a lid and a chamber bottom, the chamber bottom having an opening; and a suction device that is provided in the chamber bottom to evacuate the chamber through the opening in the chamber bottom, the suction device including a closing element that is movable from a first raised position to a second lowered position, wherein the closing element closes the opening in the chamber bottom when the closing element is in one of the raised and lowered positions, and the closing element allows access to the opening in the chamber bottom when the closing element is in the other of the raised and lowered positions;

wherein the chamber can be closed gas tight.

2. The packaging machine according to claim 1, wherein the closing element comprises a closing element surface which forms a portion of the chamber bottom when the closing element is in the raised position.

3. The packaging machine according to claim 2, wherein the closing element surface lies in a plane with, or above, an upper surface of the chamber bottom when the closing element is in the raised position.

4. The packaging machine according to claim 2, wherein the closing element surface comprises a convex surface that extends above the chamber bottom when the closing element is in the raised position.

5. The packaging machine according claim 1, further comprising a grid on the chamber bottom above the suction device.

6. The packaging machine according to claim 1, wherein the closing element comprises a valve.

7. The packaging machine according to claim 1 wherein the closing element is positioned beneath an upper surface of the chamber bottom when the closing element is in the lowered position.

8. The packaging machine according to claim 1 wherein the suction device further comprises a stationary casing part for receiving the closing element, and a sealing member provided between the casing part and the closing element for facilitating gas tight closure of the chamber when the closing element is in the raised position.

9. The packaging machine according to claim 1 wherein the suction device further comprises a piston connected to the closing element for moving the closing element, and a casing part that receives the piston.

10. The packaging machine according to claim 9 wherein the suction device further comprises an additional casing part connected to the casing part, and a piston rod that extends through the additional casing part and connects together the piston and the closing element, and wherein the closing element has a first centering portion, and the additional casing part has a second centering portion that mates with the first centering portion when the closing element is in the lowered position to guide the piston rod.

11. The packaging machine of claim 9 wherein the casing part is configured to receive pressurized air that acts on the piston to move the piston and closing element in a first direction.

12. The packaging machine of claim 11 wherein the suction device further includes a spring member that urges the piston in a second direction opposite the first direction.

13. A method for packaging of products into bags, the method comprising:

providing a packaging machine comprising a chamber having a lid and a chamber bottom having an opening, and a suction device in the chamber bottom for evacuating the chamber through the opening, the suction device including a closing element that is movable between first and second positions, wherein the closing element closes the opening in the chamber bottom when the closing element is in the first position;

closing the chamber gas tight with the closing element in the first position;

moving the closing element to the second position to provide access to the opening: and evacuating the chamber through the opening in the chamber bottom with the closing element in the second position;

wherein the closing element functions as a valve.

14. The method according to claim 13, wherein the suction device comprises a suction pipe and the evacuating step comprises evacuating gas from the chamber through the suction pipe.

15. The method according to claim 13, wherein the packaging machine further comprises a grid that is positioned above the opening and is structured and designed such that essentially only gas can enter into the suction device.

16. The method according to claim 13 wherein the closing element is positioned beneath an upper surface of the chamber bottom when the closing element is in the second position.

17. The method according to claim 13 wherein the suction device further comprises a stationary casing part for receiving the closing element, and a sealing member provided between the casing part and the closing element for facilitating gas tight closure of the chamber when the closing element is in the first position.

18. The method according to claim 13 wherein the suction device further comprises a piston connected to the closing element for moving the closing element, and a casing part that receives the piston.

19. The method according to claim 18 wherein the moving step comprises introducing air into or removing air from the casing part to move the piston, which moves the closing element to the second position.

20. The method according to claim 18 wherein the suction device further comprises an additional casing part connected to the casing part, and a piston rod that extends through the additional casing part and connects together the piston and the closing element, and wherein the closing element has a first centering portion, and the additional casing part has a second centering portion that mates with the first centering portion when the closing element is in the second position to guide the piston rod.

* * * * *